US011339659B2

(12) United States Patent
Galler et al.

(10) Patent No.: US 11,339,659 B2
(45) Date of Patent: May 24, 2022

(54) ROOF MESH INSTALLATION APPARATUS

(71) Applicant: SANDVIK INTELLECTUAL PROPERTY AB, Sandviken (SE)

(72) Inventors: Thomas Galler, Katsch/Mur (AT); Bruno Reumuller, Knittelfeld (AT)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 0 days.

(21) Appl. No.: 16/621,534

(22) PCT Filed: Jun. 12, 2017

(86) PCT No.: PCT/EP2017/064225

§ 371 (c)(1),
(2) Date: Dec. 11, 2019

(87) PCT Pub. No.: WO2018/228656

PCT Pub. Date: Dec. 20, 2018

(65) Prior Publication Data

US 2020/0141238 A1 May 7, 2020

(51) Int. Cl.
*E21D 11/40* (2006.01)
*E21D 11/15* (2006.01)

(52) U.S. Cl.
CPC ..... *E21D 11/152* (2013.01); *E21D 11/406* (2016.01)

(58) Field of Classification Search
CPC ... E21D 11/152; E21D 11/406; E21D 11/006; E21D 15/483; E21D 21/008; E21D 21/0026; E21D 21/006; E21D 20/00; E21D 11/107; E21D 21/004; E21D 23/00; E21D 21/00; E21D 21/0073; E21D 21/0053; E21D 11/40; E04C 5/12; E04C 2003/0413; E04C 2003/0421; E04C 2003/0434; E04C 2003/0452; E04C 2003/0491; E04C 2003/0486; E04C 5/0636; E04C 5/04; E04C 3/40
USPC ..... 405/258.1–302.7
See application file for complete search history.

(56) References Cited

U.S. PATENT DOCUMENTS 3,048,203 A * 8/1962 Hunter ..... E04C 5/04 140/3 R
3,399,927 A * 9/1968 Groetschel ..... E21D 23/0017 405/297
3,505,824 A * 4/1970 White ..... E21D 11/006 52/223.1

(Continued)

FOREIGN PATENT DOCUMENTS

RU 2332569 C1 8/2008
SU 846742 A1 7/1981

(Continued)

*Primary Examiner* — Edwin J Toledo-Duran
(74) *Attorney, Agent, or Firm* — Corinne R. Gorski

(57) ABSTRACT

A roof mesh installation apparatus for a mining machine includes a mesh roll carried at a dispenser at a forward position of the machine capable of unrolling mesh to be laid and bolted at a tunnel roof. A tensioning device positioned at the dispenser is capable of actuation so as to apply a pre-tension to a forward and unbolted section of mesh with the tension being applied against an already laid and rearward bolted mesh section. Accordingly, an automated roof mesh installation apparatus and method is provided.

16 Claims, 6 Drawing Sheets

(56) References Cited

U.S. PATENT DOCUMENTS 3,722,052 A * 3/1973 Toti ..... E04C 3/06 29/819
3,913,338 A * 10/1975 Galis ..... E21D 20/003 405/303
4,003,208 A * 1/1977 Hornung ..... E21D 23/0034 405/290
4,099,785 A * 7/1978 Groetschel ..... E21D 23/0026 299/33
4,122,682 A * 10/1978 Groetschel ..... E21D 11/406 299/33
4,196,935 A * 4/1980 Dring ..... E21C 35/00 299/33
4,229,043 A * 10/1980 Bell ..... E21D 23/0454 299/33
4,230,370 A * 10/1980 Cartledge ..... E21C 35/00 299/33
4,251,168 A * 2/1981 Groetschel ..... E21D 19/02 206/343
4,274,762 A * 6/1981 Johnson ..... E21D 11/006 405/259.1
4,358,159 A * 11/1982 Groetschel ..... E21D 11/406 299/33
4,379,660 A * 4/1983 Groetschel ..... E21D 19/02 156/577
5,199,825 A * 4/1993 Travis ..... E21D 11/152 299/33
5,277,520 A * 1/1994 Travis ..... E02D 29/0241 405/302.3
5,816,750 A * 10/1998 Steffenino ..... E21D 11/006 405/291
6,325,460 B1 * 12/2001 Frederick ..... B60R 21/02 299/95
6,863,476 B2 * 3/2005 Malkoski ..... E21D 20/00 405/303
8,137,033 B1 * 3/2012 Hinshaw ..... E21D 11/40 405/302.3
8,936,415 B2 * 1/2015 Lugg ..... E21D 11/403 299/33
9,187,873 B2 * 11/2015 Nelson ..... E02D 3/00
9,194,231 B2 * 11/2015 Burgess ..... E21D 5/00
9,296,436 B2 * 3/2016 Coe, Jr ..... B62D 55/04
10,851,651 B2 * 12/2020 Bischof ..... E21D 11/152
2004/0177979 A1 * 9/2004 Rubie ..... E21D 20/006 173/39
2011/0150575 A1 * 6/2011 Brown ..... E21D 11/152 405/150.1
2012/0021359 A1 1/2012 Hayama et al.
2012/0213598 A1 * 8/2012 Lugg ..... E21D 20/003 405/290
2014/0050532 A1 * 2/2014 Burgess ..... E21D 11/40 405/150.1
2019/0048719 A1 * 2/2019 Bischof ..... E21D 11/40
2020/0141238 A1 * 5/2020 Galler ..... E21D 11/406
2021/0222553 A1 * 7/2021 Zhang ..... E21D 20/00

FOREIGN PATENT DOCUMENTS

SU 889861 A1 12/1981
WO 99/67506 A1 12/1999

* cited by examiner

ROOF MESH INSTALLATION APPARATUS

RELATED APPLICATION DATA

This application is a § 371 National Stage Application of PCT International Application No. PCT/EP2017/064225 filed Jun. 12, 2017.

FIELD OF INVENTION

The present invention relates to a roof mesh installation apparatus for a mining machine and in particular, although not exclusively, to a system configured for the automated unrolling and pre-tensioning of a support mesh for securement against a roof structure.

BACKGROUND ART

Many different types of excavation and cutting machines have been developed to create drifts, tunnels, subterranean roadways and the like. For example, a mobile continuous mining machine is provided with crawler tracks to advance the machine forward, a pivoting boom mounting a rotatable cutting head to abrade into rock and a conveyor system to discharge rearwardly material cut from the rock face for subsequent rearward transportation.

As will be appreciated, for reasons of safety and forward cutting efficiency, it is important to stabilise and support the tunnel roof continuously as the machine is advanced. This is typically achieved via roof bolter units installed at the lateral sides of the machine that cooperate with a plurality of temporary roof supports (TRS) that may be raised vertically to engage the roof behind the cutting head. In particular, as the machine is advanced forward and the TRS system is engaged to support the roof, a mesh screen carried at the machine is typically elevated and bolted to the roof. Example roof support dispensing apparatus are described in U.S. Pat. Nos. 4,358,159; 5,816,750; US 2012/0213598 and U.S. Pat. No. 8,137,033. However, existing mesh installation systems can be susceptible to mesh sagging both during and post installation. Accordingly, any free-space between the mesh and roof is inevitably in-filled with rock and fines which reduces the cross sectional area of the as-created tunnel. Additionally, existing arrangements are often restricted to single or predefined bolt spacing settings that in turn limit machine forward advancement rates and hence mining capacity. Accordingly, what is required is a mining machine provided with a roof mesh installation system offering enhanced mesh layout flexibility and resulting roof support effectiveness.

SUMMARY OF THE INVENTION

It is an objective of the present invention to provide a roof mesh installation apparatus for a mining machine capable of creating an effective rock support installation to suit particular rock types and situations. It is a further objective to provide supporting mesh installation apparatus offering variable machine forward advancement rates and enhanced mining capacity.

It is a further specific objective to provide mesh installation apparatus that may be conveniently integrated at a mining machine to provide an automatic or semi-automated system of roof support installation that maximises tunnel cross sectional area whilst minimising the risk of partial roof collapse or sagging during and post installation. It is a specific objective to provide an automated support installation apparatus offering flexibility of bolt spacing (in a lengthwise direction of the machine) and high capacity advancement rates to suit a variety of different rock types and situations as desired.

The objectives are achieved by providing a roof support installation system configured to apply a pre-tension to a mesh sheet as it is placed against the roof immediately prior to bolting in position. Applying a pre-tension to the mesh as it is unrolled automatically at the roof is advantageous to ensure the mesh is forced in a pre-tensioned state tight against the rock at the roof surface as the mesh is bolted in position. Variation of the magnitude of the pre-tension and the bolt spacing serves to maximise the strength of the rock support at the roof and achieve high machine advancement rates as required. In particular, the present system provides a fully automated or semi-automated arrangement of unrolling, pre-tensioning and bolting of mesh whilst the mining machine is advanced.

According to a first aspect of the present invention there is provided roof mesh installation apparatus for a mining machine comprising: a dispenser to mount a roll of mesh ready for unrolling and securement against a roof by bolting; characterised by: a tensioning device having a mesh engaging portion configured to be moved to penetrate into or through the mesh so as to lock the tensioning device to the mesh and allow a forward and unbolted section of the mesh to be tensioned against a rearward and already bolted section of the mesh by forward and/or upward movement of the tensioning device prior to bolting.

The forward and/or upward movement of the tensioning device is preferably provided by at least one mechanical actuator mounted at the machine and in particular the dispenser. Such an actuator may be considered a component part of the tensioning device. Optionally, a forward movement of the tensioning device may be provided by forward advancement of the mining machine that provides a corresponding forward translational advancement of the tensioning device. Accordingly, such forward and/or upward movement of the tensioning device may be relative to a last set of bolts mounting the mesh to the roof, the roll of mesh mounted at the dispenser, other components of the dispenser, the mining machine main frame, a primary or secondary temporary roof support member (TRS) or the tunnel roof.

The dispenser and tensioning devices are configured to work cooperatively according to an automated or semi-automated mechanism such that mesh tensioning is achieved via the tensioning device acting against the existing bolted section of mesh. That is, the tensioning device is capable of being raised or moved in a forward direction (in the longitudinal length of the mining machine) such that tension is created in the longitudinal direction between the tensioning device and the last set of bolts. Preferably, the tensioning device extends or has components that are positioned at intervals widthwise across the mining machine so as to apply a generally uniform tension primarily in the lengthwise and secondly in widthwise directions.

Preferably, the tensioning device comprises a prong, fork or fingers configured to penetrate into or through the open structure of the mesh. Optionally, the tensioning device may comprise a wheel, drum or roll having radially extending projections, ribs, barbs or teeth (for example having a cog-like configuration) such that at least parts of the tensioning device are capable of being inserted into the open spacings of the mesh (as defined by mesh webbing) to effectively bite into the mesh. Accordingly, any forward movement of the tensioning device provides a corresponding tension to the mesh as the mesh is effectively coupled or positioned locked against the tensioning device and incapable of passing or sliding over the tensioning device via independent movement.

Preferably, the dispenser comprises a support frame to support the roll and at least one mechanical actuator to provide a raising and lowering of the support frame. Optionally, the mechanical actuator comprises a linear actuator such as a hydraulic cylinder or the like. Preferably, the dispenser if mounted at the mining machine via a plurality of mechanical actuators. Optionally, the mechanical actuators are pivotally mounted at the machine to allow forward and rearward movement of the dispenser in addition to a raising and lowering movement.

Preferably, the apparatus further comprises at least one primary roof support member capable of being raised to press against the roof as a temporary roof support. Preferably, the primary TRS comprises a series of pads that are distributed to extend widthwise across the apparatus and the mining machine immediately behind a forward end of the mining machine for example a widthwise extending rotatable cutting head. Preferably, the primary TRS members comprise a plate-like structure having a generally planar upper face for contact against the roof of the tunnel. Preferably, the present installation apparatus is positioned immediately behind the forward end of the mining machine which is advantageous to minimise a surface area of unsupported roof.

Preferably, the apparatus further comprises at least one secondary roof support member positioned in a lengthwise direction of the mining machine to be rearward of the primary roof support member, the secondary roof support member capable of being raised to press against the roof as a temporary roof support generally in the same plane as the primary roof support member. Optionally, a surface area of an upward facing surface of the primary roof support member is greater than a corresponding surface of the secondary roof support member. Additionally, the primary roof support member may extend a greater distance in the widthwise direction relative to the secondary roof support member. Optionally, a separation distance in the longitudinal direction between the primary and secondary roof support members may be approximately equal to a width of the primary roof support member (in the lengthwise direction of the mining machine). That is, relative to a full length of the mining machine, the secondary roof support is positioned a close separation distance behind the primary roof support member. Such a configuration is advantageous to provide suitable roof support at the forward region of the mining machine immediately behind the cutting head.

Preferably, the roll is mounted below the primary roof support member so as to be at least partially shielded from the roof by the primary roof support member. Such an arrangement is advantageous to shield the roll from rock and fines falling from the roof so as to ensure a smooth unrolling of the mesh and allow the tensioning device to engage into the mesh unobstructed in order to apply pre-tensioning immediately prior to bolting. Additionally, the positioning of the mesh roll immediately underneath the primary support member provides a compact configuration enabling the present invention to be installed at the very forward end of a mining machine to maximise roof support and minimise any unsupported surface area.

Preferably, the roll is mountable in a lengthwise direction of the mining machine and below the primary roof support member so as to be capable of unrolling and extending upwardly towards the roof and between the primary and the secondary roof support members in the lengthwise direction of the mining machine. Such an arrangement is advantageous to maximise roof support provided by the TRS system whilst achieving a compact configuration that may be conveniently installed and operated at a mobile mining machine cooperatively with bolting units and additional components.

Optionally, the primary roof support member is connected to the support frame and configured to be raised and lowered by the mechanical actuator. Utilising common components to provide the mounting and actuation of the primary support member and support frame of the dispenser minimises component parts of the apparatus which is advantageous for weight saving and to achieve a compact design. However, and preferably the apparatus comprises a plurality of linear mechanical actuators configured for linear extension and retraction. Such actuators are required to support and stabilise the apparatus across the full width of a mining machine such that the active TRS is fully supported and tensioning is capable of being applied across the full width of the mesh.

Optionally, the secondary roof support member is mounted at the dispenser via at least one mechanical actuator to be configured for independent raising and lowering relative to the primary roof support member. Optionally, the secondary roof support member is mounted at the dispenser so as to be configured for cooperative raising and lowering relative to the primary support member. Optionally, the first and second roof support members may be coupled together to provide a unitary structure capable of being manipulated (i.e. raised and lowered) as a unitary assembly. Preferably, the mesh roll is mounted at the apparatus so as to be capable of being raised and lowered cooperatively with the primary roof support member and/or the secondary roof member.

Preferably, the tensioning device is mounted at the dispenser via at least one mechanical actuator so as to be capable of being independently movable relative to the support frame, the primary roof support member and/or the secondary roof support member. Accordingly, the tensioning device may be moved forward and rearward (in the lengthwise direction of the machine) and/or raised and lowered independently of the primary roof support member and/or the secondary roof support members. This is advantageous such that when the primary and secondary roof support members are active in engagement with the roof, the tensioning device may be independently moved (i.e. raised and/or moved forward) to apply the tensioning to the mesh without affecting the roof support. Optionally, the mechanical actuator comprises a linear mechanical actuator capable of linear extension and retraction.

According to a second aspect of the present invention there is provided a mobile mining machine comprising: a chassis, endless tracks and a motor to propel the machine over a floor or ground; at least one bolting unit moveably mounted at the machine to insert bolts through unrolled mesh at the roof; and roof mesh installation apparatus as claimed herein.

Optionally, the mobile mining machine is a cutting machine having a cutting head mounted at a forward end. Optionally, the mining machine may comprise a continuous mining machine, a bolter-miner, a bolter or other machine being a dedicated roof support installation device.

Optionally, the mining machine further comprises at least one wall mesh installation apparatus, the wall mesh installation apparatus comprising: a dispenser to mount a mesh roll ready for unrolling and securement against a wall by bolting; and a tensioning device having a mesh engaging portion configured to be moved to penetrate into or through the mesh so as to lock the tensioning device to the mesh and allow a forward and unbolted section of the mesh to be tensioned against a rearward and already bolted section of the mesh by forward and/or laterally inward or outward movement of the tensioning device prior to bolting. Preferably, the mining machine comprises a pair of wall mesh installation apparatus positioned at either lateral side of the machine. Preferably, the wall mesh installation apparatus is configured to work independently and in a coordinated manner with the roof mesh installation apparatus so as to provide an automated or semi-automated roof and wall mesh installation system and apparatus.

BRIEF DESCRIPTION OF DRAWINGS

A specific implementation of the present invention will now be described, by way of example only, and with reference to the accompanying drawings in which.

DETAILED DESCRIPTION OF PREFERRED EMBODIMENT OF THE INVENTION

Figure 1:
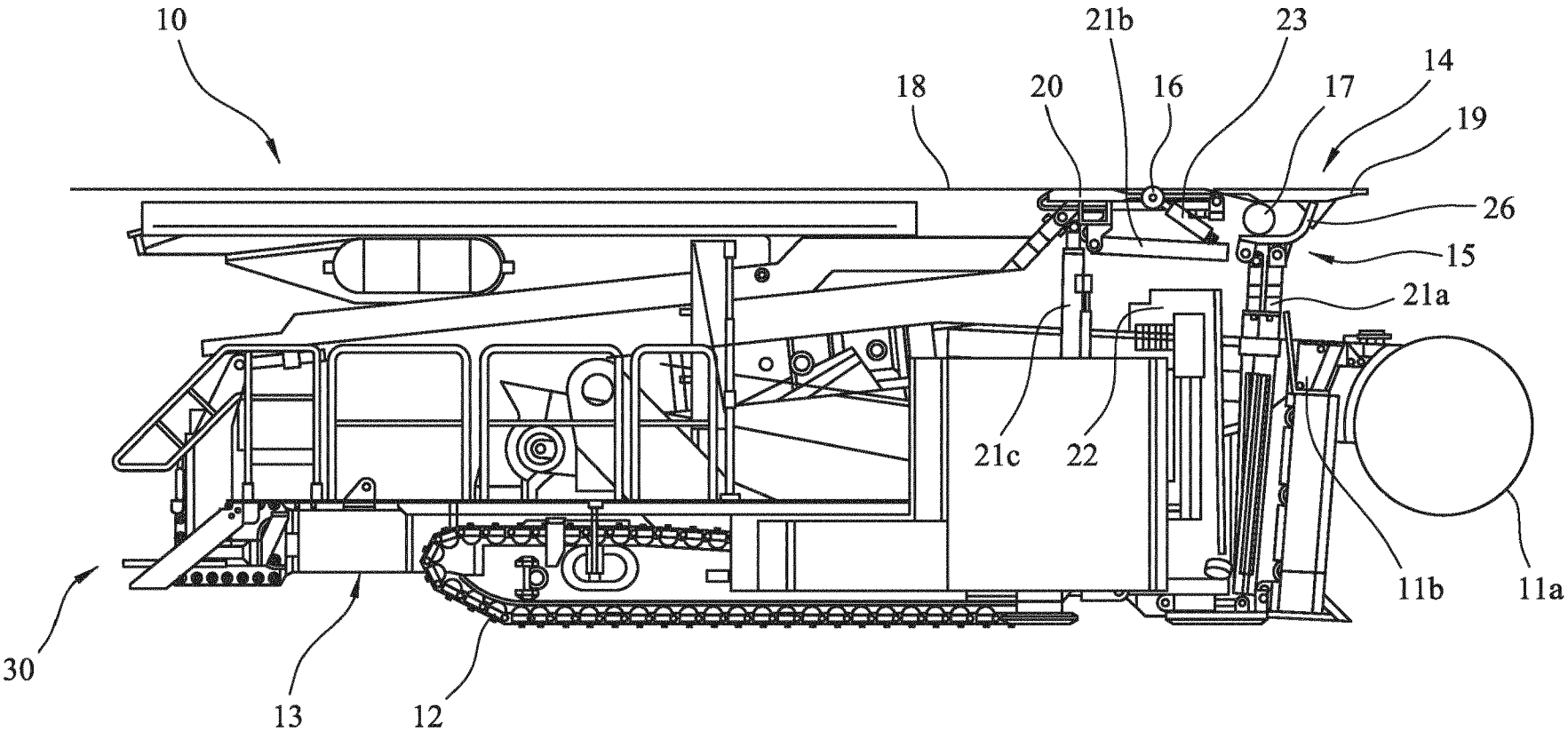
FIG. 1 is a side elevation view of a mobile mining machine having a roof mesh installation apparatus according to a specific implementation of the present invention.
Figure 2:
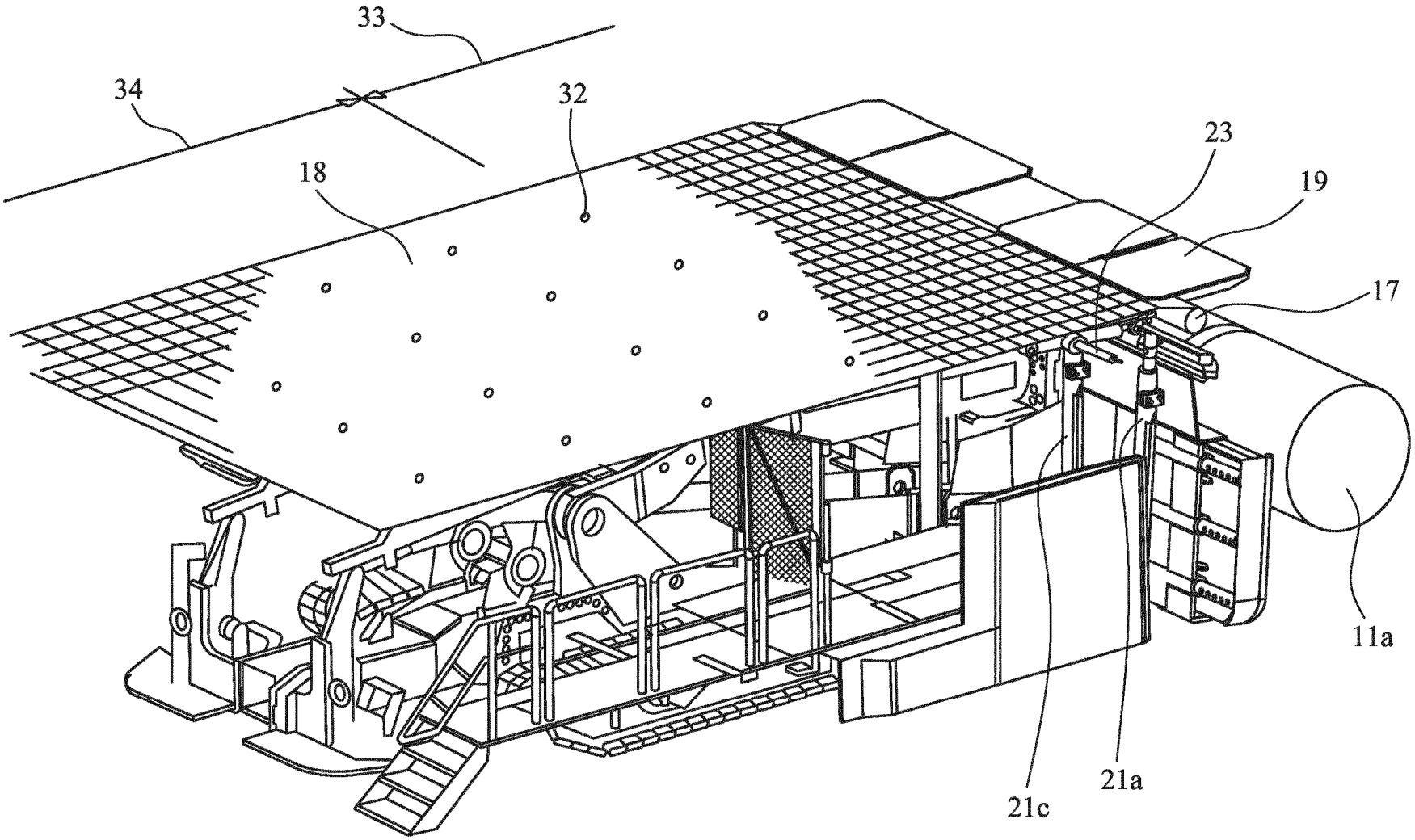
FIG. 2 is a perspective view of the mining machine of FIG. 1.

Referring to FIGS. 1 and 2, a mobile mining machine 10 comprises a pair of endless tracks 12 mounted at a chassis or mainframe 13 capable of moving the machine 10 over the ground or a floor of an underground tunnel and the like. A motor (not shown) is mounted at mainframe 13 and is configured to drive tracks 12 according to conventional machine arrangements. A rotatable cutting head 11*a* is mounted at a pivoting boom arm 11*b* and is capable of being raised and lowered to abrade the rock both as the machine 10 is advanced forward and cutting head 11*a* is raised and lowered.

A roof mesh installation apparatus 14 is mounted at a forward end of machine 10 and is configured to provide both a temporary support to a roof section newly created by cutting head 11*b* and to provide a substantially permanent roof support in the form of a bolted mesh installed at the roof. Mesh installation apparatus 14 comprises a dispenser 15 that positionally supports a mesh roll 17 in close proximity to the roof such that the mesh, when unrolled from roll 17, is capable of being laid against the roof as illustrated generally by reference 18. Dispenser 15 comprises a plurality of mechanical actuators preferably in the form of hydraulic linear actuators 21*a*, 21*b*, 21*c* configured to provide a raising and lowering and optionally a forward and rearward displacement of the upper components of the dispenser 15 relative to the roof. Dispenser 15 further comprises a frame illustrated generally as reference 26 (referring to FIG. 5) to provide a means of supporting mesh roll 17 in a position ready for unrolling at the roof. Frame 26 further supports a series of primary roof support members 19 that extend widthwise across the mining machine 10 between respective lateral sides of the machine 10. Roof support members 19 are formed as a series of pads having generally planar upward facing contact surfaces 28 which are capable of being pressed to sit against the roof via actuation of actuators 21*a*. Machine 10 further comprises at least one secondary roof support member 20 positioned in the lengthwise direction rearward of the primary roof support members 19 referring to FIGS. 3 and 4. Accordingly, a gap region 29 is provided between the primary and secondary roof support members 19, 20 in a lengthwise direction of the mining machine 10 relative to the forwardmost cutting head 11*a* and a rearwardmost machine end 30. Secondary roof support member 20 similarly comprises a planar upward facing contact surface 31 configured to be pressed against the roof via actuation of linear actuators 21*c* and 21*b*. According to the specific implementation, the forward and rearward roof support members 19, 20 provide an active temporary roof support system (TRS) to support and stabilise newly cut portions of roof prior to installation of the roof mesh. Advantageously, the active TRS 19, 20 is positioned immediately behind cutting head 11*a* so as to minimise the surface area of unsupported roof and accordingly reduce the risk of roof collapse or sagging. In particular, forwardmost ends of the primary roof support members 19 are positioned in the lengthwise direction of the mining machine 10 directly over at least a rearward portion of the cutting head 11*a* and/or a forwardmost end of boom arm 11*b*.

Linear actuators 21*a*, 21*c* are aligned to extend in the upward direction having first lower ends mounted indirectly at machine mainframe 13 and respective second upper ends connected to dispenser support frame 26, primary roof support members 19 and/or secondary roof support member 20. Additionally, a set of linear actuators 21*b* are aligned to extend generally in a horizontal plane (in the lengthwise direction of the machine 10) between the forward and rearward primary and secondary roof support members 19, 20. Such a configuration is advantageous to provide independent roof adjustment of the primary and secondary support members 19, 20 so as to maximise the effect of the active TRS to support the newly created roof area. Additionally, the actuators 21*b* may be adapted to provide adjustment of the separation distance between the members 19, 20 and accordingly variation of the length of the gap region 29. The different sets of linear actuators 21*a*, 21*b*, 21*c* extend widthwise across machine 10 so as to positionally support the primary and secondary support members 19, 20 (also extending widthwise across the machine 10 between its lateral sides). The active TRS is accordingly capable of being raised and lowered and to some extent pivoted forward and rearward relative to machine mainframe 13 as a unitary assembly in addition to some independent movement between the primary and secondary support members 19, 20 as mentioned.

Figure 3:
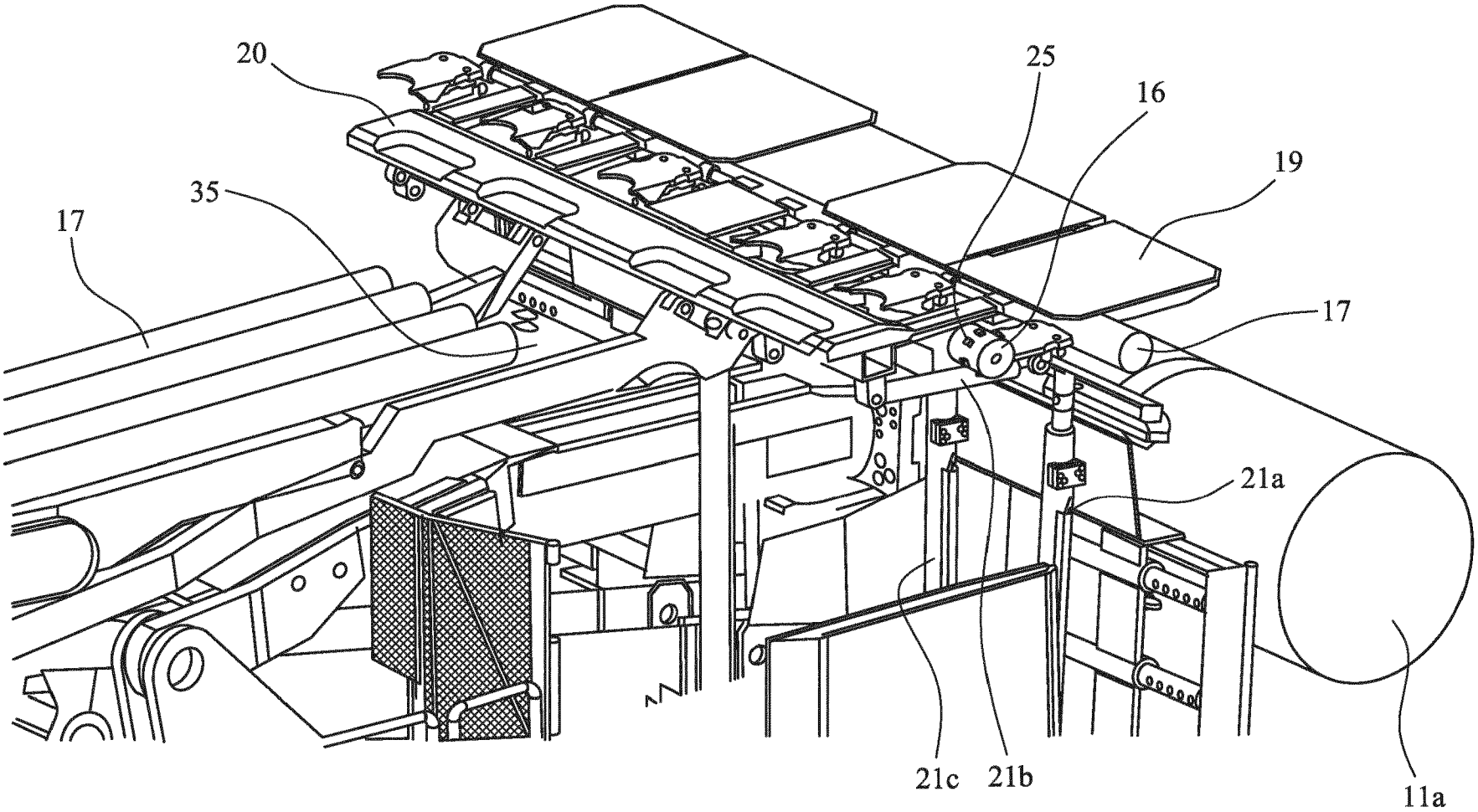
FIG. 3 is a further perspective view of a forward end of the mining machine of FIG. 2.
Figure 4:
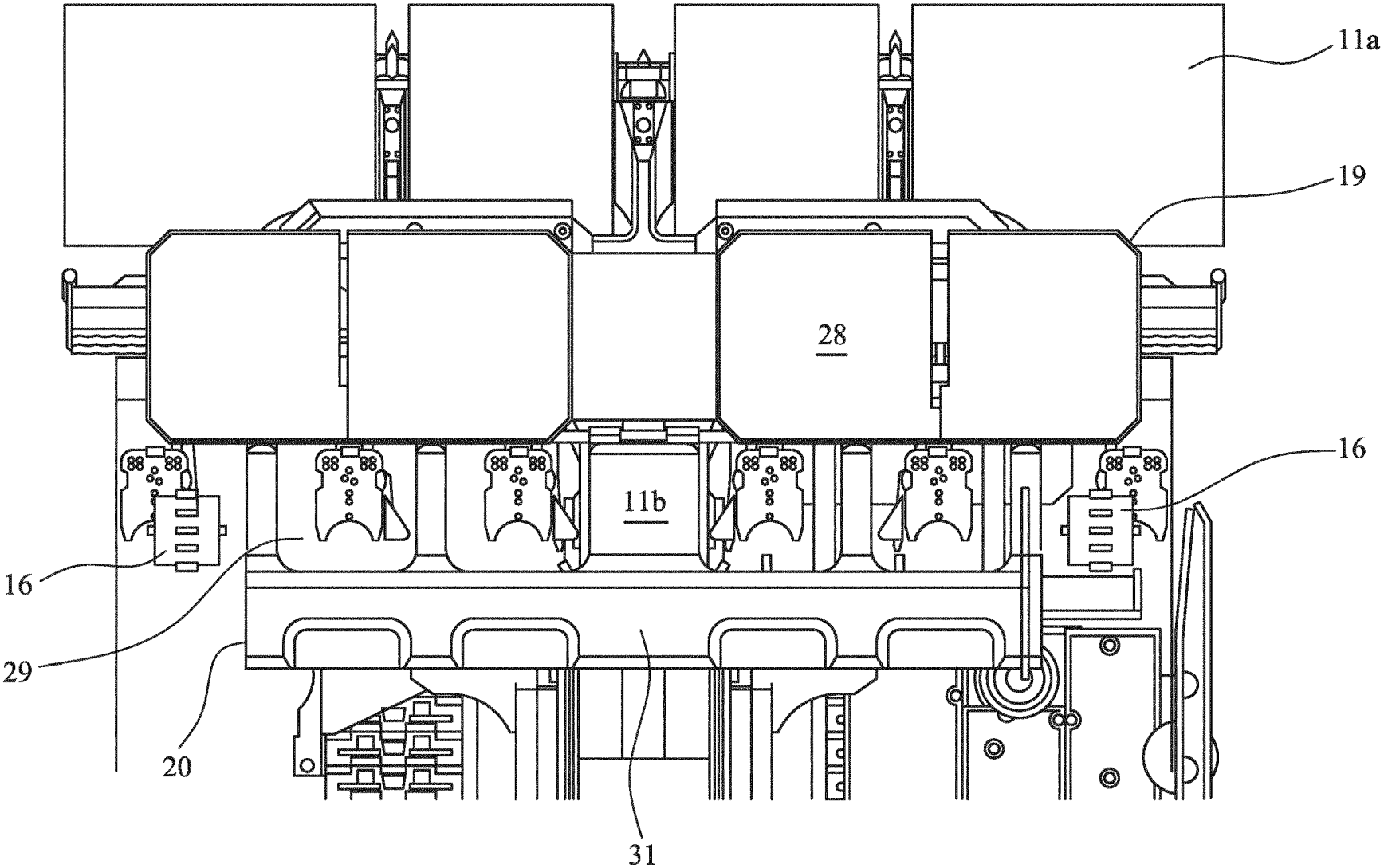
FIG. 4 is a plan view of the forward end of the mining machine of FIG. 3.

Mining machine 10 further comprises a set of bolting units 22 preferably mounted at or towards each of the lateral sides of the machine 10. Only a single bolting unit is illustrated in FIG. 1 and the units 22 are not shown in FIGS. 2 to 4 for illustrative purposes. As will be appreciated, the bolting units 22 are mounted at the machine 10 via a series of actuators so as to be capable of being raised and lowered relative to the roof to deliver roof support bolts into the roof at predetermined lengthwise intervals. Referring to FIG. 2, bolting units 22 are configured to install roof bolts 32 across the width of the machine 10 to create widthwise extending rows of bolts 32 separated from one another in the lengthwise direction of machine 10 as is conventional in the art. Bolts 32 are installed in position by units 22 as the mesh sheeting 18 is unrolled and the machine 10 is advanced forward. Accordingly, at a given roof installation time period a rearward section 34 of the mesh 18 is securely affixed to the roof via the rows of bolts 32 whilst a forward section 33 of the mesh 18 is newly unrolled and is unbolted ready for securing in position by the units 22. As illustrated in FIG. 3, machine 10 further comprises an upper region 35 to store mesh rolls 17 ready for mounting in position ready for dispensing against the tunnel roof. Machine 10 further comprises a tensioning device illustrated generally by reference 16 having a mesh engaging portion 25 referring to FIGS. 3 and 5 or portion 16*a* referring to FIG. 6. Referring to FIG. 4, and according to the specific implementation machine 10 comprises a plurality of tensioning devices 16 in the form of two drums 24 (or wheels) positioned towards the lateral sides of the machine 10 and in lengthwise direction between the primary and secondary roof support members 19, 20. According to further specific implementations, machine 10 may comprise a single tensioning device extending widthwise across the machine 10 as an elongate cylinder or a plurality of discreet tensioning devices 16 (arranged at the same lengthwise region of the machine 10) and extending widthwise across the machine 10 as a seemingly unitary tensioning device capable of being applied to the mesh as a collective unit. According to the specific implementation, each tensioning device 16 formed as a drum 24 is provided with a mesh engaging portion 25 in the form of raised teeth that project radially outward from the otherwise cylindrical drum 24. Teeth 25 are distributed in a circumferential direction around drum 24 and project radially via an appropriate length so as to be capable of engaging into and through holes 27 within the mesh 18 (as defined by the lengthwise and widthwise extending webbing of the mesh body). According to the specific implementation, each tensioning device 16 is mounted at the dispenser 15 via at least one respective actuator 23 in the form of a hydraulic linear actuator having a first end mounted at or towards support frame 26 (referring to FIG. 5) and a second end connected to drum 24. Accordingly, each tensioning device 16 is capable of being raised and lowered and moved forward and rearward via each actuator 23. Accordingly, each tensioning device 16 whilst being mounted at the dispenser 15, is capable of independent movement relative to the dispenser frame 26 and optionally the primary and secondary roof support members 19, via each independent linear actuator 23. As will be appreciated, each tensioning device 16 may be mounted at the dispenser 15 via respective single or multiple actuators and movement mechanisms so as to provide positional adjustment of each tensioning device 16 relative to other components of the mining machine 10 including in particular mainframe 13 and the selected components of the roof mesh installation apparatus as indicated above.

Figure 5:
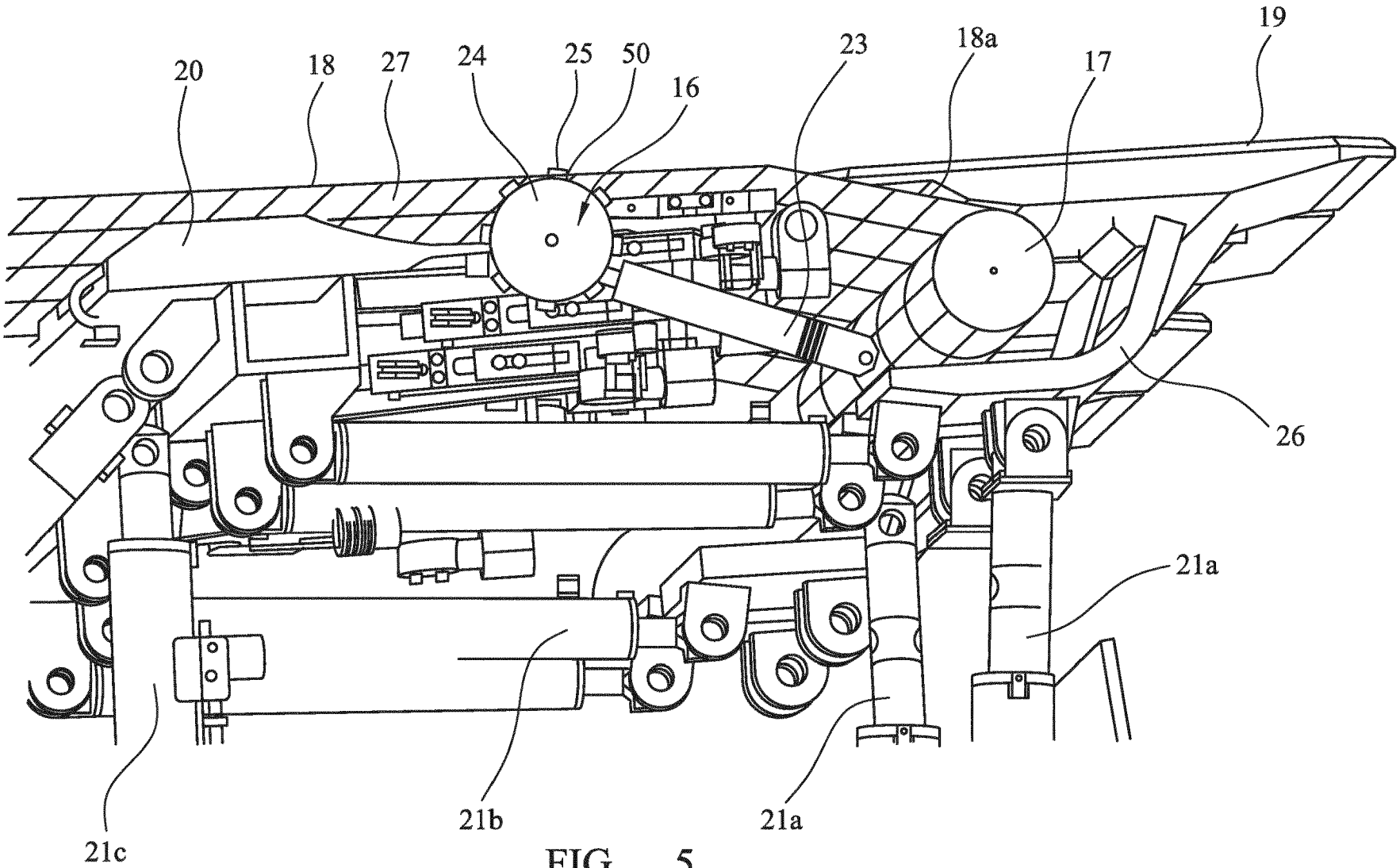
FIG. 5 is an underside perspective view of the forward end of the mining machine of FIG. 4 according to the specific implementation of the present invention.

As illustrated in FIG. 5, the dispenser 15 is configured, via support frame 26 and associated components, to mount the mesh roll 17 at a position immediately below the primary roof support members 19 so as to shield the roll 17 from rock and fines falling from the roof. As will be noted, it is important that the open structure of the mesh does not become obstructed that would otherwise prevent the tensioning device 16 (and in particular engaging portion 25) from penetrating the mesh and in turn the positional coupling of the tensioning device 16 and the mesh 18 to impart the pre-tension prior to mesh bolting. The mounting of the roll 17 under the plate-like members 19 also ensures the mesh 18 is capable of unrolling freely which is important for uninterrupted and efficient forward advancement via an automated or semi-automated roof mesh installation process.

Figure 6:
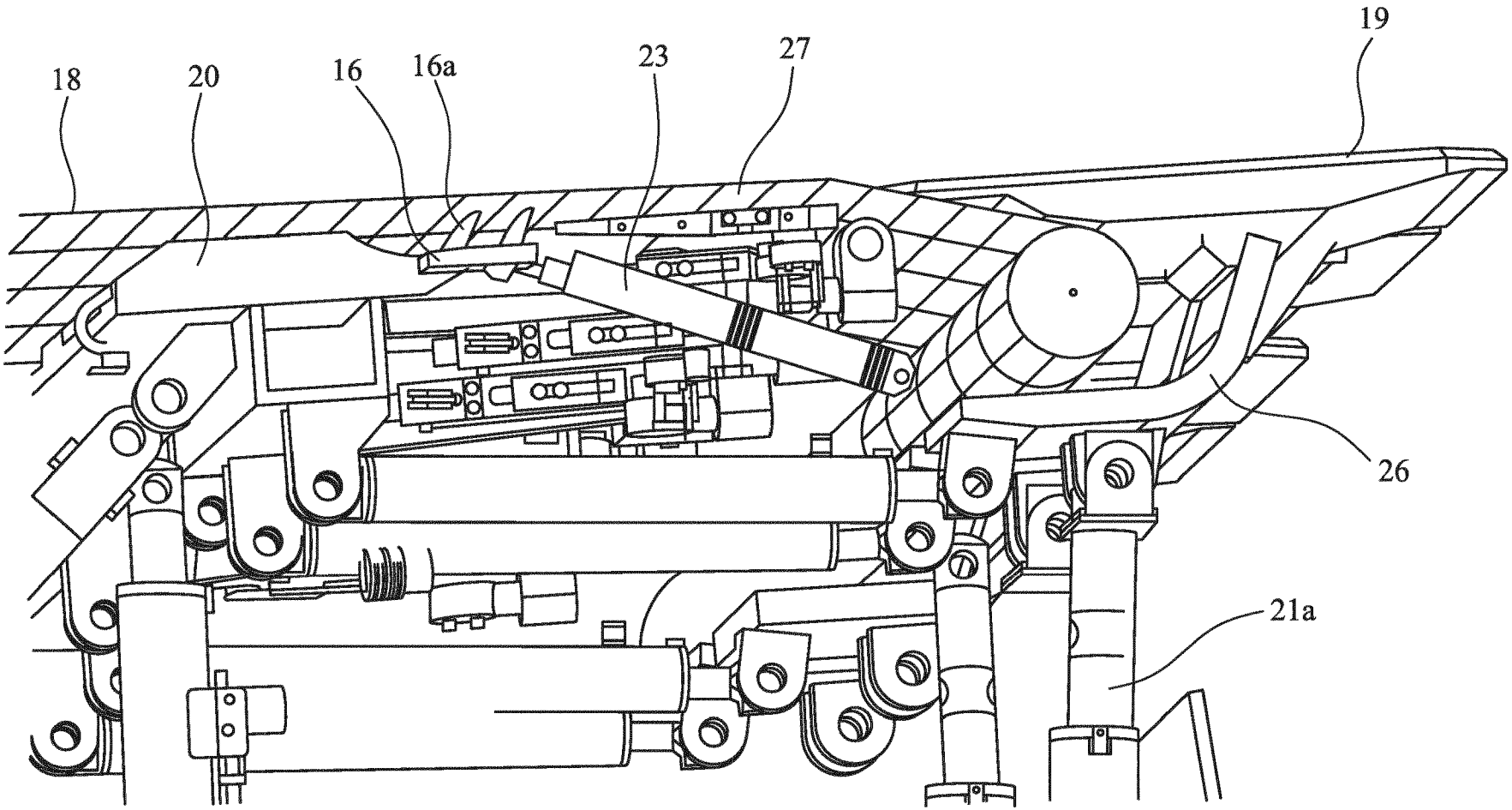
FIG. 6 is an underside perspective view of the forward end of a mining machine according to a further embodiment of the present invention.

FIG. 6 illustrates a further embodiment of the subject invention in which the tensioning device 16 is formed as a sled having upwardly projecting fingers 16*a*. Each of the fingers 16*a* comprise a sufficient length to engage into and penetrate mesh 18 by insertion into the open structure represented by holes 27 as described with reference to the embodiment of FIGS. 3 and 5.

Referring to the embodiments of FIGS. 1 to 6 and in use, the rotatable cutting head 11*a* is forced against the rock by forward movement of the machine 10 (via tracks 12) and the pivoting action of boom arm 11*b*. This forward and upward movement creates a new section of roof that is supported temporarily by raising and pressing the primary and secondary roof support members 19, 20 against the new roof section. At a very initial stage of rock cutting and roof support installation, a length of mesh 18 is unrolled from roll 17 so as to extend upwardly at section 18*a* to emerge at and in contact with the roof in the lengthwise direction between the primary and secondary support members 19, 20. The mesh is then laid rearwardly along the roof between the forward and rearward machine ends where it is bolted in position via the lengthwise separated rows of bolts 32 (inserted by bolting units 22). As the machine 10 is advanced a new unbolted section 33 of mesh 18 is dispensed to sit against the roof according to a continuous automated process. Accordingly, the mesh at the roof may be divided into a rearward bolted section 34 and a forward unbolted section 33 with the interface between the sections 33, 34 divided by the most recent installed row of bolts 32 referring to FIG. 2. Each tensioning device 16 is then moved forwardly to engage into mesh 18 via teeth 25 (or fingers 16*a*) so as to be positionally coupled or locked to the mesh 18 and in particular the unbolted forward section 33. Actuators 23 then provide further forward translational movement to each tensioning device 16 that is effective to apply a pulling force to the forward unbolted mesh section 33 which is resisted by the already laid bolted section 34 (and in particular the latest row of bolts 32) to create the desired pre-tension. The unbolted section 33 when placed under pre-tension is then bolted via units 22 resulting in a further row of bolts 32. The machine 10 then continues forward advancement according to the automated cutting and roof mesh installation process. Such a process is advantageous via the continuous unrolling, tensioning and bolting of the mesh 18 to allow selective adjustment of the frequency of bolt placement (with regard to lengthwise separation between rows of bolts 32) in addition to the magnitude of the pre-tension that is applied. Accordingly, a mining machine 10 is provided offering flexibility of bolt spacing so as to achieve a desired high capacity advancement rate. Adjustment of bolting density is also advantageous to achieve the most efficient rock support installation fitting for specific rock types and tunnel environments. Applying a predetermined pre-tension to the forward mesh section 33 is further advantageous to maximise the cross sectional area of a tunnel which is important when installing secondary utilities such as conduits for lighting, ventilation and other functions. The pre-tensioned bolted mesh installation is beneficial to provide maximised rock retention at the roof with minimised or no roof sagging within the tunnel.

According to further specific implementations, the mining machine 10 may be provided with lateral roof mesh installation apparatus positioned at the lateral sides of the machine so as to install pre-tensioned mesh at the tunnel walls in parallel to the roof support installation as described. As will be appreciated, such lateral wall mesh installation devices comprise identical or similar components as described with reference to FIGS. 1 to 6 including in particular respective dispensers 15 having frames 26 to support mesh rolls 17 to extend generally in the vertical plane and respective tensioning devices 16 to create the required pre-tension as the mesh 18 is laid and bolted to the tunnel walls. Such lateral wall mesh installation devices may or may not comprise primary and/or secondary support members 19, 20 as will be appreciated.

The invention claimed is:

1. A roof mesh installation apparatus for a mining machine comprising:

a dispenser arranged to mount a roll of mesh ready for unrolling and securement against a roof by bolting;

a tensioning device having a mesh engaging portion, the tensioning device being movable between a first position wherein the mesh engaging portion penetrates into or through an open structure of the mesh so as to lock the tensioning device to the mesh and a second position wherein a forward and unbolted section of the mesh is tensioned against a rearward and already bolted section of the mesh by forward and/or upward movement of the tensioning device prior to bolting, the tensioning device being selected from a wheel, drum or roll; and at least one mechanical actuator mounted at the machine configured to provide the forward and/or upward movement of the tensioning device.

2. The apparatus as claimed in claim 1, wherein the mesh engaging portion includes teeth, a prong, a fork or fingers configured to penetrate into or through the open structure of the mesh.

3. The apparatus as claimed in claim 1, wherein the dispenser includes a support frame arranged to support the roll and the at least one mechanical actuator to provide a raising and lowering of the support frame.

4. The apparatus as claimed in claim 1, further comprising at least one primary roof support member arranged to be raised to press against the roof as a temporary roof support.

5. The apparatus as claimed in claim 4, further comprising at least one secondary roof support member positioned in a lengthwise direction of the mining machine arranged rearward of the at least one primary roof support member, the at least one secondary roof support member being arranged to be raised to press against the roof as a temporary roof support.

6. The apparatus as claimed in claim 4, wherein the roll is mounted below the at least one primary roof support member so as to be at least partially shielded from the roof by the at least one primary roof support member.

7. The apparatus as claimed in claim 5, wherein the roll is mountable in a lengthwise direction of the mining machine and below the at least one primary roof support member so as to be capable of unrolling and extending upwardly towards the roof and between the at least one primary and the at least one secondary roof support members in the lengthwise direction of the mining machine.

8. The apparatus as claimed in claim 3, wherein the at least one primary roof support member is connected to the support frame and configured to be raised and lowered by the mechanical actuator.

9. The apparatus as claimed in claim 8, wherein the mechanical actuator includes a plurality of linear mechanical actuators configured for linear extension and retraction.

10. The apparatus as claimed in claim 5, wherein the at least one secondary roof support member is mounted at the dispenser via at least one mechanical actuator to be configured for independent raising and lowering relative to the at least one primary roof support member.

11. The apparatus as claimed in claim 5, wherein the tensioning device is mounted at the dispenser via the at least one mechanical actuator so as to be independently movable relative to the support frame, the at least one primary roof support member and/or the at least one secondary roof support member.

12. The apparatus as claimed in claim 11, wherein the mechanical actuator includes a linear mechanical actuator capable of linear extension and retraction.

13. A mobile mining machine comprising:

a chassis, endless tracks and a motor arranged to propel the machine over a floor or ground;

at least one bolting unit moveably mounted at the machine to insert bolts through unrolled mesh at the roof; and a roof mesh installation apparatus as claimed in claim 1.

14. The mobile mining machine as claimed in claim 13, wherein the mining machine is a cutting machine having a cutting head mounted at a forward end of the machine.

15. The machine as claimed in claim 14, further comprising at least a pair of bolting units.

16. A roof mesh installation apparatus for a mining machine comprising:

a dispenser arranged to mount a roll of mesh ready for unrolling and securement against a roof by bolting;

a tensioning device having a mesh engaging portion, the tensioning device being movable between a first position wherein the mesh engaging portion penetrates into or through an open structure of the mesh so as to lock the tensioning device to the mesh and a second position wherein a forward and unbolted section of the mesh is tensioned against a rearward and already bolted section of the mesh by forward and/or upward movement of the tensioning device prior to bolting, the tensioning device being selected from a wheel, drum or roll;

at least one mechanical actuator mounted at the machine configured to provide the forward and/or upward movement of the tensioning device; and at least one primary roof support member arranged to be raised to press against the roof as a temporary roof support, wherein the roll is mounted below the at least one primary roof support member.

* * * * *